United States Patent [19]

Szwartz

[11] 4,273,097

[45] Jun. 16, 1981

[54] AUTOMATIC FIREPLACE DAMPER

[76] Inventor: Henry S. Szwartz, 17 Terrace Ave., Suffern, N.Y. 10901

[21] Appl. No.: 898,772

[22] Filed: Apr. 24, 1978

[51] Int. Cl.[3] ..... F23L 1/00; F23N 3/00

[52] U.S. Cl. ..... 126/285 B; 110/163; 431/20

[58] Field of Search ..... 237/45; 431/20, 22; 126/285 R, 285 A, 285 B, 285.5, 296, 293, 2; 110/163, 147; 340/627, 628, 629; 98/115 VM, 115 R

[56] References Cited

U.S. PATENT DOCUMENTS

| | | | |
|---|---|---|---|
| 3,773,028 | 11/1973 | Schreibeis | 126/285 B |
| 3,951,051 | 4/1976 | Dry | 126/285 B |

*Primary Examiner*—Samuel Scott
*Assistant Examiner*—J. Anderson

[57] ABSTRACT

This device provides a means of automatically detecting smoke in a room, through an ionization chamber, prior to it being noticed by humans. It consists primarily of an automatic control unit, which through a small servomotor will open the fireplace damper in step fashion, or close it to conserve heat. It further includes a manual over-ride switch for use when desired.

5 Claims, 2 Drawing Figures

AUTOMATIC FIREPLACE DAMPER

This invention relates to fireplaces, and more particularly to an automatic fireplace damper.

It is, therefore, the principle object of this invention to provide an automatic fireplace damper, which will employ a smoke detector that will, through its ionization chamber, and a control unit, operate a servo-motor that will by step means, open and close the flue damper, so as to enable a fireplace to operate more efficiently.

Another object of this invention is to provide an automatic fireplace damper, which will have a servo-motor coupled to the flue shaft of the chimney, so as to rotate it. When a fire is burning in the fireplace, all the hot air travels up the chimney, and when the damper is closed, and the fire is lit, the fumes or ionized particles enter the room. The smoke detector picks up the particles and opens the flue on the chimney in degrees, until the room ceases to have the ionized particles.

A further object of this invention is to provide an automatic fireplace damper, which will employ a manual switch, which will over-ride the automatic control unit when the user desires.

Another object of the invention is to provide an automatic fireplace damper, which will be simple in design, inexpensive to manufacture, and efficient in operation.

These, and other objects of the invention, are to provide an automatic fireplace damper, which will be readily evident upon a study of the following specifications and accompanying drawing wherein:

FIG. 1 is a side view of the present invention shown installed in a room, and.

Figure 1:
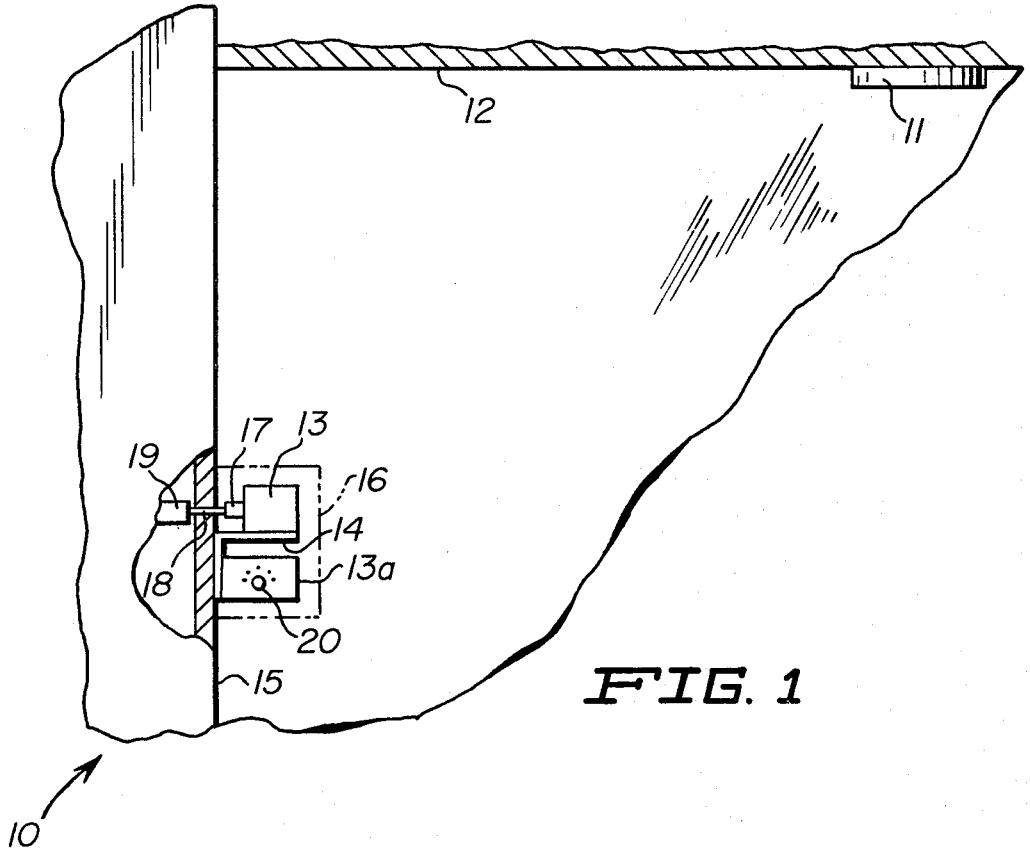
Figure 2:
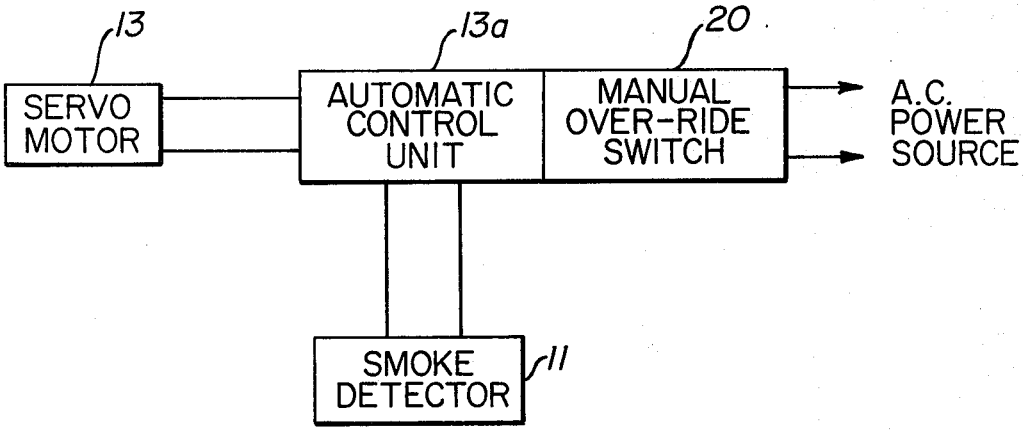
FIG. 2 is a block diagram of the invention.

According to this invention, an automatic fireplace damper 10 is shown to include a smoke detector 11, which is secured to the ceiling 12 of a room in a well known manner. A servo-motor 13 is fastened to a bracket 14 in a suitable manner, and bracket 14 is secured to chimney 15. An automatic control unit **13*a* is also secured to bracket 14, and the servo motor 13 and the automatic control unit 13*a* are covered by means of a removable housing 16, which is shown in phantom in FIG. 1 of the drawing. A coupling 17 of motor 13, connects motor 13 to shaft 18 of flue 19, so as to open and close it. The smoke detector 11 is a battery operated ionization type and the servo motor 13** is powered by an alternating current source.

A manually operated switch 20 provides a means of overriding the automatic control unit **13*a* for controlling the servo motor 13** when desired by the user, particularly, when the battery of the smoke detector is too weak.

When smoke detector 11 is activated by smoke in the room, servo-motor 13 slowly opens flue 19 by means of the automatic control unit **13*a*. The motor is then stopped by timer means in control unit 13*a*. If this is sufficient to clear the smoke, the unit stops and holds at that position. If not, the detector 11 will remain activated, and open flue 19 a few more stops. If the smoke clears, the motor 13 will start to close flue 19 in small increments, until it stops at the fully closed position, preventing the room's heated air from wastefully travel up the chimney 15**.

While various changes may be made in the detail construction, it is understood that such changes will be within the spirit and scope of the present invention, as is defined by the appended claims.

What I now claim is:

1. A firebox with a flue and damper, comprising a smoke detector located in a room with the firebox, an automatic control unit for controlling a servo-motor secured to said flue, said servo-motor acting to open and close said damper, a manual override switch for controlling said servo-motor operation when desired, and bracket means securing said servo-motor and said automatic control unit to said flue, said automatic control unit being activated by said smoke detector to open said damper in incremental steps when smoke enters said room by closing an alternating current circuit to said servo-motor.

2. The combination according to claim 1, wherein the output shaft of said servo-motor is secured stationary to said damper by coupling means to its shaft, and said servo-motor is secured by suitable fastner means to said bracket means, which is secured by suitable fasteners to the flue's outer peripheral wall surface, and said servo-motor is reversible in rotation by said automatic control unit to close the flue to prevent the heated air from wastefully traveling up the flue chimney.

3. The combination according to claim 2, wherein said manual over-ride switch is secured in said alternating current circuit of said servo-motor in said automatic control unit, which by-passes the said smoke detector circuit for full manual control by said servo-motor.

4. The combination according to claim 1, where said smoke detector is of the battery operated ionization chamber type.

5. The combination according to claim 1, where said control unit includes a timer for controlling the spacing of said incremental steps.

* * * * *